United States Patent [19]

Boger et al.

[11] Patent Number: 5,065,943

[45] Date of Patent: Nov. 19, 1991

[54] NOZZLE CAP FOR AN ADHESIVE DISPENSER

[75] Inventors: Bentley J. Boger, Atlanta, Ga.; Thomas C. Jenkins, Amherst, Ohio

[73] Assignee: Nordson Corporation, Westlake, Ohio

[21] Appl. No.: 578,810

[22] Filed: Sep. 6, 1990

[51] Int. Cl.[5] ..... B05B 1/34; B21P 1/02

[52] U.S. Cl. ..... 239/298; 239/424; 239/4; 72/112

[58] Field of Search ..... 239/424.5, 425, 425.5, 239/290, 291, 292, 296, 298, 4, 600; 29/890.142, 890.143, 243.517; 72/122

[56] References Cited

U.S. PATENT DOCUMENTS

| | | | |
|---|---|---|---|
| Re. 33,481 | 12/1990 | Ziecker et al. . | |
| 721,900 | 3/1903 | Lassoe et al. . | |
| 1,960,724 | 5/1934 | Bramsen . | |
| 2,102,382 | 12/1937 | Roselund . | |
| 2,324,055 | 7/1943 | Bohelka | 72/112 X |
| 2,626,424 | 1/1953 | Hawthorne, Jr. . | |
| 2,646,313 | 7/1953 | Peeps . | |
| 3,004,719 | 10/1961 | Poappirt | 239/424.5 X |
| 3,053,461 | 9/1962 | Inglis . | |
| 3,152,923 | 10/1964 | Marshall et al. . | |
| 3,252,657 | 5/1966 | Winegar . | |
| 3,556,411 | 2/1971 | Nord et al. | 239/581 |
| 3,668,869 | 6/1972 | De Lorsa et al. | 239/433 X |
| 3,764,069 | 10/1973 | Runstadler, Jr. et al. . | |
| 3,825,379 | 7/1974 | Lohkamp et al. . | |
| 3,841,567 | 10/1974 | Drozek et al. . | |
| 3,920,362 | 11/1975 | Bradt . | |
| 4,185,981 | 1/1980 | Ohsato et al. . | |
| 4,219,157 | 8/1980 | Binoche . | |
| 4,334,637 | 6/1982 | Baker et al. | 239/600 X |
| 4,349,947 | 9/1982 | Rood | 239/599 |
| 4,383,648 | 5/1983 | Lunquist et al. | 239/424.5 X |
| 4,411,389 | 10/1983 | Harrison . | |
| 4,767,057 | 8/1988 | Degli et al. . | |
| 4,785,996 | 11/1988 | Ziecker et al. . | |
| 4,815,660 | 3/1989 | Boger . | |
| 4,934,445 | 6/1990 | Plata et al. | 239/290 X |
| 4,969,602 | 11/1990 | Scholl . | |

FOREIGN PATENT DOCUMENTS

| | | | |
|---|---|---|---|
| 0222379 | 11/1986 | European Pat. Off. . | |
| 0333902 | 3/1988 | European Pat. Off. . | |
| 2553664 | 10/1976 | Fed. Rep. of Germany . | |
| 81/01670 | 6/1981 | PCT Int'l Appl. . | |
| 1109198 | 8/1984 | U.S.S.R. . | |
| 1240465 | 6/1986 | U.S.S.R. . | |
| 0909427 | 10/1967 | United Kingdom . | |
| 2034618 | 6/1980 | United Kingdom | 72/112 |
| 1587898 | 4/1981 | United Kingdom . | |

OTHER PUBLICATIONS

Nordson Drawing No. 00860999.

*Primary Examiner*—Andres Kashnikow
*Assistant Examiner*—Kevin P. Weldon
*Attorney, Agent, or Firm*—Wood, Herron & Evans

[57] ABSTRACT

A nozzle cap, adapted for use with an adhesive dispensing device which includes a gun body and a nozzle having an adhesive passageway and an air passageway, comprising a nozzle mounting portion or nut permanently mounted to a nozzle plate formed with a stepped throughbore having an inlet with a seat which mounts an O-ring and a plurality of spaced air jet bores located radially outwardly from the throughbore and O-ring. Both the nut and nozzle plate are machined separately, and then are substantially permanently interconnected by roll-forming an end of the nut onto the peripheral edge of the nozzle plate. When the nut portion of the nozzle cap is assembled on the nozzle of the adhesive dispensing device, the nozzle plate is positioned such that its stepped throughbore communicates with the adhesive passageway in the nozzle and its air jet bores communicate with the air passageway in the nozzle. An adhesive bead is extruded through the stepped throughbore in the nozzle plate, and this bead is impacted by air jets from the spaced air jet bores which stretch or attenuate the adhesive bead to form an elongated adhesive fiber for deposition in a controlled spiral spray pattern onto a substrate.

12 Claims, 3 Drawing Sheets

NOZZLE CAP FOR AN ADHESIVE DISPENSER

FIELD OF THE INVENTION

This invention relates to adhesive dispensing devices, and, more particularly, to a nozzle cap for the nozzle of an adhesive dispenser which produces an elongated strand or fiber of adhesive in a controlled pattern for deposition onto a substrate.

BACKGROUND OF THE INVENTION

Hot melt thermoplastic adhesives have been widely used in industry for adhering many types of products, and are particularly useful in applications where quick setting time is advantageous. One application for hot melt adhesive which has been of considerable interest in recent years is the bonding of non-woven fibrous material to a polyurethane substrate in articles such as disposable diapers, incontinence pads and similar articles.

In applications of this type, dispensing devices have been utilized which form the hot melt adhesive in an elongated, thin strand or fiber which is deposited atop the non-woven material. Such dispensing devices typically include a nozzle formed with an adhesive discharge opening and one or more air jet orifices through which a jet of air is ejected. A bead of adhesive is extruded from the adhesive discharge opening in the nozzle which is then impinged by the air jets to attenuate or stretch the adhesive bead forming a thin fiber for deposition onto the substrate. Examples of dispensing devices which are capable of dispensing a viscous material in the form of an elongated strand or fiber are disclosed in U.S. Pat. Nos. 2,626,424 to Hawthorne, Jr.; U.S. Pat. No. 3,152,923 to Marshall et al; and, U.S. Pat. No. 4,185,981 to Ohsato et al.

In applications such as the formation of disposable diapers, it is important to carefully control the pattern of the adhesive fiber deposited onto the non-woven substrate in order to obtain the desired bond strength between the non-woven layer and polyurethane substrate using as little adhesive as possible. Improved control of the pattern of adhesive fibers has been obtained in dispensing devices of the type described above by impacting the adhesive bead discharged from the nozzle with air jets directed substantially tangent to the adhesive bead. The tangentially applied air jets control the motion of the elongated fiber of adhesive, and confine it in a relatively tight, or compact, spiral pattern for application onto the substrate. Examples of devices capable of forming an elongated adhesive fiber, and depositing the fiber in a controlled pattern onto a substrate, are disclosed in the '424 Hawthorne, Jr. patent and the '981 Ohsato et al patent mentioned above.

In order to produce a compact spiral spray pattern of an adhesive fiber in the dispensing devices described above, it is important to ensure that the air jets are directed tangentially relative to the bead of adhesive ejected from the nozzle area of the dispensing device. This requires accurate placement of the bores or passageways through which pressurized air is ejected, which are typically on the order of about 0.015 to 0.020 inches in diameter. The boring or drilling of passageways having such a small diameter at the appropriate angles in the nozzle and/or gun body of prior art dispensing devices is a relatively expensive and difficult machining operation.

This problem has been overcome by the nozzle attachment disclosed in U.S. Pat. No. 4,785,996, which is assigned to the same assignee as this invention. The nozzle attachment disclosed in U.S. Pat. No. 4,785,996 is adapted to mount to the nozzle of a standard adhesive gun which is formed with an adhesive discharge opening connected to an adhesive passageway in the gun body, and an air discharge opening connected to an air passageway in the gun body. The nozzle attachment is an annular plate formed with a boss extending outwardly from a first surface of the plate and a nozzle tip extending outwardly from a second surface of the plate. A throughbore is formed between the boss and nozzle tip which communicates with the adhesive discharge opening in the nozzle of the gun body when the plate is mounted to the nozzle. Heated hot melt adhesive is transmitted from the adhesive passageway in the gun body, through the adhesive discharge opening in the nozzle and then into the throughbore in the plate. The adhesive is ejected as an extruded bead through the nozzle tip of the plate toward a substrate.

The nozzle attachment of U.S. Pat. No. 4,785,996 is formed with an annular notch or groove which extends from its first surface having the boss toward the second surface formed with the nozzle tip, and is located radially outwardly from the throughbore in the plate. The annular groove is provided to assist in drilling bores in the plate through which jets of pressurized air are directed at an angle of about 30°, and substantially tangent to, the adhesive bead ejected from the nozzle tip. One surface of the annular groove is oriented substantially perpendicular to the axis of movement of the drill bit, i.e., at an angle of about 30° relative to the first and second surfaces of the plate, and sufficient clearance is provided within the annular groove to avoid interference with the drill bit. As a result, sliding of the drill bit relative to the plate is minimized during the drilling or boring operation which helps locate the air jet bores at the desired angle in the plate.

While the nozzle attachment disclosed in U.S. Pat. No. 4,785,996 facilitates accurate drilling of the air jet bores and produces an acceptable spiral pattern of a strand or fiber of adhesive, some deficiencies have been discovered in certain applications. The annular plate is mounted to the nozzle by a threaded mounting nut, and it has been found that the mounting nut can be over-torqued when the annular plate is installed. Such over-torquing of the mounting nut urges the annular plate against the nozzle of the gun with such force that the annular plate can deflect or distort thus creating a leakage path at the interface between the annular plate and nozzle. In some instances, it has been found that hot melt adhesive entering the throughbore in the annular plate has flowed radially outwardly along this leakage path into the annular groove where the pressurized air enters the air jet bores in the annular plate. This can clog the air jet bores and thus restrict the flow of air necessary to attenuate or stretch the adhesive bead to form an elongated adhesive fiber.

In addition to overtightening of the annular plate, another problem can occur during the assembly operation. Because the annular plate and mounting nut are separate pieces, the operator must properly orient the annular plate relative to the nozzle of the gun body before securing it with the mounting nut. Occasionally, the annular plate is installed upside down, i.e., with the nozzle tip facing the nozzle and the boss facing outwardly, which ruins the nozzle tip and requires replacement of the entire annular plate.

Another potential problem with the nozzle attachment disclosed in U.S. Pat. No. 4,785,996 is that its outer or second surface having the nozzle tip is not mounted flush with the rim of the mounting nut which secures the annular plate to the nozzle of the gun body. As a result, a cavity or space is formed between the nozzle tip and the rim of the nut. Particularly when the dispenser is operated intermittently, it has been found that cut-off drool, i.e., adhesive remaining after the gun is shut off, can collect in the space or cavity between the nozzle tip and mounting nut. This cut-off drool can collect and clog the air jet bores formed in the nozzle attachment, thus inhibiting the formation of an elongated adhesive fiber. In addition, a collection of adhesive fibers within such cavity is difficult to clean.

The potential problems with the nozzle attachment disclosed in U.S. Pat. No. 4,785,996 have been addressed in a one-piece nozzle cap manufactured and sold by Nordson Corporation of Amherst, Ohio, the assignee of this invention. The nozzle cap is formed from a section of hex-shaped bar stock such that the mounting nut and annular plate are integrally formed in a single, unitary construction instead of two separate pieces as in U.S. Pat. No. 4,785,996. A bore is drilled and tapped in the hex stock to form the mounting nut portion of the nozzle cap, and the annular plate is formed where such bore terminates. A first side or surface of the annular plate is thus located within the interior of the mounting nut portion of the nozzle cap, and the opposite, second surface is flush with the end of the mounting nut portion so that there is no rim or cavity between the annular plate and mounting nut as in the U.S. Pat. No. 4,785,996 described above.

The one-piece nozzle cap therefore eliminates the collection of adhesive at the outer surface of the annular plate, and prevents installation of the annular plate upside down, which are potential problems with the nozzle attachment disclosed in U.S. Pat. No. 4,785,996. Nevertheless, a number of difficulties are presented in the installation and fabrication of this one-piece nozzle cap. Although formed in one piece, the nozzle cap can be overtightened on the nozzle of the dispensing device wherein the mounting nut portion is over-torqued causing the annular plate portion to deflect or distort against the nozzle of the dispensing device. This can create the same type of leakage problems between the throughbore in the plate and the air jet bores therein described above in connection with U.S. Pat. No. 4,785,996.

With respect to the problems created during the machining operation, initially an annular groove or notch must be machined in the first surface of the annular plate to receive pressurized air for the air jet bores, and this is a difficult machining operation because access within the interior of the mounting nut portion of the nozzle cap is restricted. In fact, access is so restricted that a drill bit cannot be introduced at the proper angle within the interior of the mounting nut portion to drill the air jet bores from the high pressure or first surface of the annular plate toward the second surface. As a result, the air jet bores must be drilled from the opposite direction, i.e., from the second surface of the plate having the nozzle tip toward the first surface formed with the annular groove. While not absolutely required, an annular groove is also preferably formed in this second surface to facilitate such drilling operation. These different machining operations are performed on opposite sides of the cap which requires that it be turned over during the machining process which further adds to the time and cost of fabrication of the part.

Another problem in the machining operation of this nozzle cap is attributable to the inherent dimensional inaccuracies of hex bar stock. Such dimensional inaccuracies create difficulties in machining the air jet holes within the annular plate portion of the nozzle cap with the accuracy required to properly form elongated strands or fibers of adhesive.

SUMMARY OF THE INVENTION

It is therefore among the objectives of this invention to provide a nozzle cap adapted to mount to the nozzle of an adhesive dispensing device in order to produce an elongated strand or fiber of adhesive in a spiral pattern on the substrate, which avoids leakage of adhesive received from the dispensing device, which resists clogging with adhesive, which is easy to correctly install, which is comparatively easy and inexpensive to manufacture and which effectively attenuates or stretches an adhesive bead to form an elongated adhesive fiber.

These objectives are accomplished in a nozzle cap adapted for use with an adhesive dispensing device which includes a gun body and a nozzle having an adhesive passageway and an air passageway. In the presently preferred embodiment, the nozzle cap comprises a nozzle mounting portion or nut permanently mounted to a nozzle plate formed with a stepped throughbore and a plurality of spaced air jet bores located radially outwardly from the throughbore. Both the nut and nozzle plate are machined separately, and then are substantially permanently interconnected by roll-forming an end of the nut flush with the peripheral edge of the nozzle plate. When the nut portion of the nozzle cap is assembled on the nozzle of the adhesive dispensing device, the nozzle plate is positioned such that its stepped throughbore communicates with the adhesive passageway in the nozzle and its air jet bores communicate with the air passageway in the nozzle. An adhesive bead is extruded through the stepped throughbore in the nozzle plate, and this bead is impacted by air jets from the spaced air jet bores which stretch or attenuate the adhesive bead to form an elongated adhesive fiber for deposition in a controlled spiral spray pattern onto a substrate.

One aspect of this invention is therefore predicated on the concept of forming a two-piece nozzle cap in which each piece is separately machined, and then the two pieces are substantially permanently connected to one another. This avoids the installation problems of the type discussed above in connection with U.S. Pat. No. 4,785,996, reduces the difficulty and cost of the machining operations and results in less scrap.

With respect to the problem of adhesive leakage described above, the nozzle plate portion of the nozzle cap is preferably formed with a seat at the inlet to its stepped throughbore. This seat mounts an O-ring substantially concentric to the stepped throughbore, and in a position between the stepped throughbore and the air jet bores formed in the nozzle plate. The O-ring reduces the potential for overtightening of the nozzle cap during installation, and provides a fluid-tight seal between the stepped throughbore and air jet bores.

As mentioned above, one problem with both the nozzle attachment disclosed in U.S. Pat. No. 4,785,996, and the nozzle cap machined from hex bar stock, is that the annular plate could be overtightened during installation causing a distortion or bending of the annular plate resulting in leakage of the hot melt adhesive into the air jet bores and an inaccurate spray pattern. The O-ring employed in the nozzle cap of this invention substantially reduces the potential for overtightening of the nozzle plate during the assembly operation by providing a three-stage assembly sequence in which each stage is readily discernible by the operator performing the installation.

Initially, the nut portion of the nozzle cap is threaded onto the mating, external threads formed in the nozzle of the dispensing device and the nut freely and easily rotates and travels along the nozzle with minimal resistance therebetween. Preferably, the O-ring protrudes above the upper surface of the nozzle plate so that it contacts the lowermost end of the nozzle before the upper surface of the nozzle plate makes contact. Once the O-ring contacts the nozzle, it begins to compress, and this compression is felt by the operator as a resistance to further tightening of the nozzle cap. In other words, the operator can feel a clear difference between rotation of the nut along the nozzle before and after contact with the O-ring. In the third stage of the assembly operation, the O-ring is sufficiently compressed so that the upper, metallic surface of the nozzle plate engages the lowermost end of the nozzle. At this point, the operator can feel positive contact between the nozzle plate and nozzle of the dispensing device and substantial resistance to further tightening, which indicates that the nozzle cap has been fully seated on the nozzle.

The three-stage assembly operation described above substantially reduces the potential for overtightening of the nozzle plate against the lowermost end of the nozzle. The operator can readily feel when metal-to-metal contact is made between the nozzle plate and nozzle of the dispensing device, whether the assembly is performed by hand or with a tool such as a wrench. This avoids further tightening of the nozzle cap, and thus reduces the chance of distorting or bending the nozzle plate during the installation procedure.

In addition to the advantage provided by the O-ring during the assembly operation, the O-ring also ensures that a substantially fluid-tight seal is maintained between the stepped throughbore in the nozzle plate which receives adhesive, and the air jet bores formed in the nozzle plate which receive pressurized air. It is important to prevent a leakage path from developing between the stepped throughbore and air jet bores so that the adhesive is not permitted to escape into the air jet bores where it can clog them and inhibit operation of the nozzle cap. The O-ring is held within the seat formed in the nozzle plate, and against the lowermost end of the nozzle, but the inner diameter of the O-ring is not confined and the adhesive passes therethrough. Because the adhesive is delivered under pressure, the flow of adhesive through the O-ring tends to force the O-ring radially outwardly from the stepped throughbore of the nozzle plate against the seat and lowermost end of the nozzle, thus further enhancing the seal between the stepped throughbore and the air jet bores formed in the nozzle plate.

The number, location and orientation of the air jet bores in the nozzle plate portion of the nozzle cap herein is substantially the same as disclosed in U.S. Pat. No. 4,785,996. As discussed therein, the air jet bores are positioned at about a 30° angle with respect to the axis of the stepped throughbore in the nozzle plate and oriented to direct air jets substantially tangent to the periphery of the bead extruded through the stepped throughbore. The air jets emitted from the air jet bores both attenuate or stretch the extruded bead of adhesive to form an elongated adhesive strand or fiber, and also impart a twisting or swirling motion to the elongated strand so that it is deposited in a spiral-like pattern upon the substrate.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
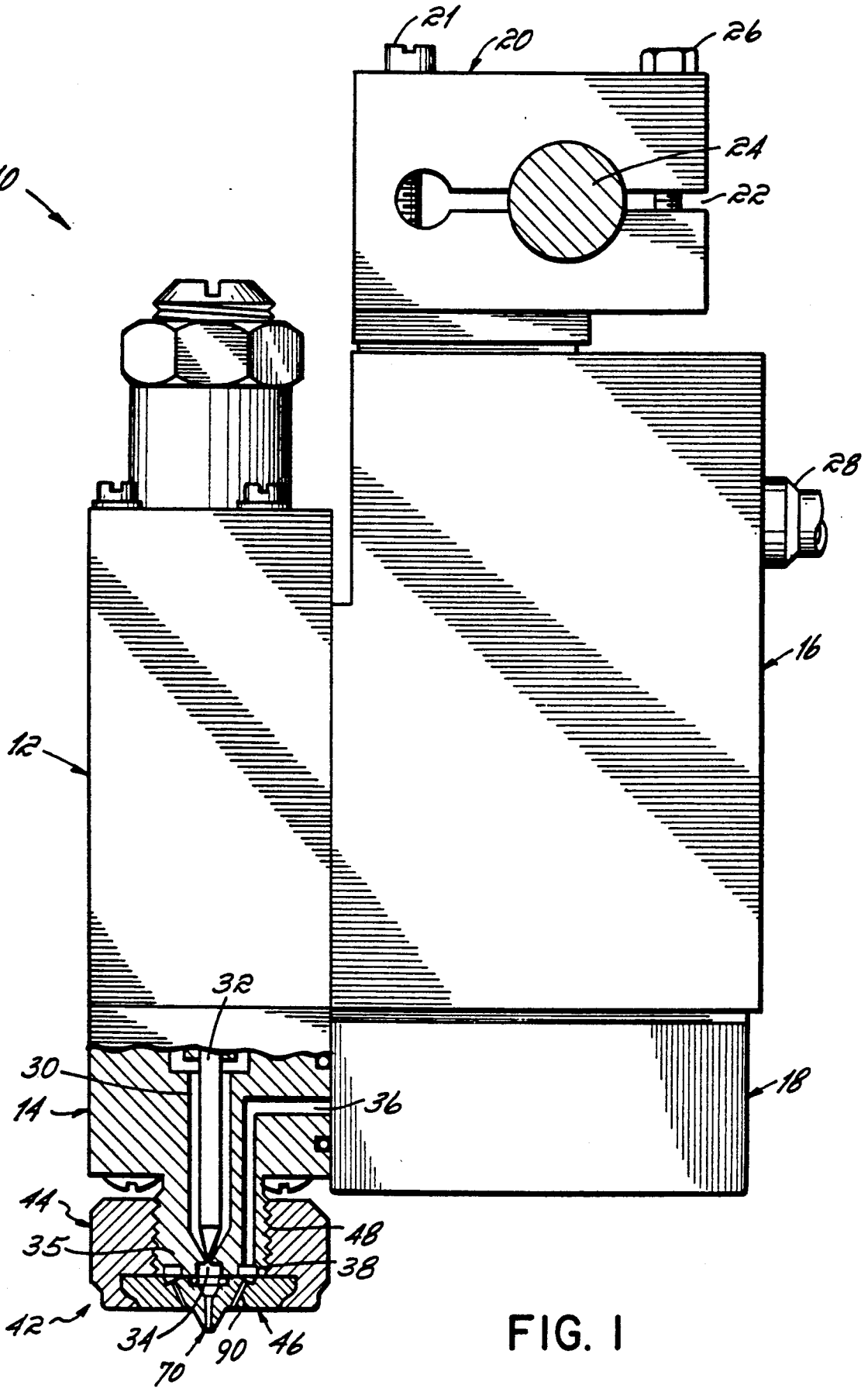
FIG. 1 is a view in partial cross section of a dispensing device incorporating the nozzle cap of this invention.

Referring to FIG. 1, an adhesive dispensing device 10 is illustrated comprising a gun body 12 having a nozzle 14 connected by screws 15 at one end, an adhesive manifold 16 mounted to the gun body 12 and an air manifold !8 mounted to the nozzle 14. The adhesive manifold 16 is affixed to a mounting block 20 by one or more screws 21, and the mounting block 20 is formed with a slot 22 adapted to receive a support rod 24. The mounting block 20 is tightened down on support rod 24 by one or more screws 26 to carry the adhesive manifold 16, air manifold 18 and gun body 12 and position the nozzle 14 at the desired location with respect to a substrate (not shown).

The detailed construction and operation of the gun body 12, adhesive manifold 16 and air manifold 18 form no part of this invention per se and are thus not described herein. Reference should be made to U.S. Pat. No. 4,785,996 to Ziecker et al for a detailed description of same, the disclosure of which is incorporated by reference in its entirety herein. For purposes of the present discussion, the adhesive manifold 16 is formed with an adhesive inlet 28 connected to an internal passage (not shown) which supplies adhesive to a stepped bore 30 formed in the nozzle 14. A plunger 32 is movable within this stepped bore 30 with respect to a discharge outlet 34 formed at the lowermost end 35 of nozzle 14. Similarly, the air manifold 18 is formed with internal passages (not shown) connected to a source of pressurized air. These internal passages connect to an L-shaped air passageway 36 in the nozzle 14 which terminates at an annular cavity 38 formed in the lowermost end 35 of nozzle 14.

This invention is predicated upon the concept of adapting the above-described elements of dispensing device 10 for the production of an elongated, adhesive fiber or strand in a substantially spiral-shaped pattern upon a substrate. This adaptation is made possible by the nozzle cap 42 of this invention. The nozzle cap 42 includes a nozzle mounting portion or nut 44 which, as described in detail below, is either integrally formed or substantially permanently affixed to a nozzle plate 46 preferably formed of phosphor bronze material. In either embodiment, the nozzle cap 42 herein has an essentially unitary construction.

Figure 2:
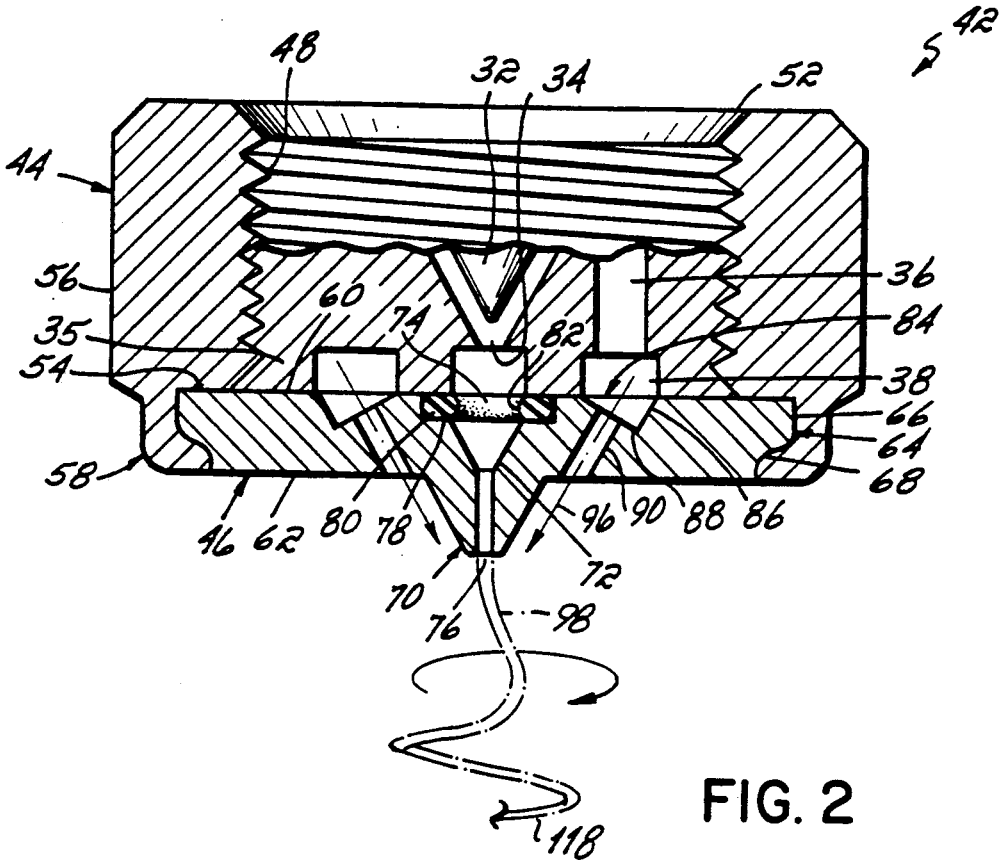
FIG. 2 is an enlarged cross sectional view of the nozzle cap of this invention attached to the nozzle of the dispensing device.
Figure 3:
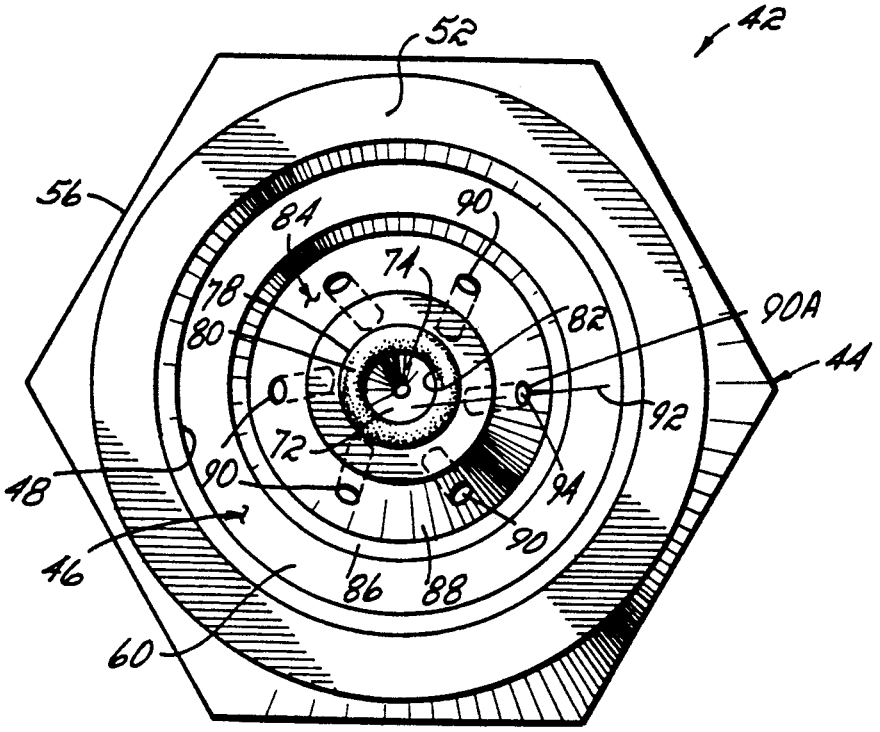
FIG. 3 is a top view of FIG. 2 of the nozzle cap of this invention without showing the dispensing device.

With reference to the embodiment illustrated in FIGS. 2 and 3, the nut portion 44 of nozzle cap 42 is preferably a stainless steel nut having internal threads 48 which mate with the external threads on the exterior surface of the nozzle 14. The nut 44 has an inner end 52, an outer end 54 and a hex-shaped peripheral surface 56. An annular flange 58 extends outwardly from the outer end 54 of nut 44. For purposes of the present description, the term "inner" refers to a direction toward the nozzle 14, and the term "outer" refers to a direction away from the nozzle 14 with the nozzle cap 42 mounted to the nozzle 14 as shown in FIG. 1.

In the embodiment of this invention illustrated in FIGS. 2 and 3, the nozzle plate 46 is formed with an inner surface 60, an outer surface 62 and a peripheral edge 64. This peripheral edge has a substantially straight annular portion 66 extending from the inner surface 60 toward the outer surface 62, and a concavely arcuate portion 68 extending between the straight portion 66 and the outer surface 62 of nozzle plate 46.

Preferably, the nozzle plate 46 includes a nozzle tip 70 which extends outwardly from the outer surface 62 thereof. A stepped throughbore 72 is formed in the nozzle plate 46 having an inlet 74 at the inner surface 60 of nozzle plate 46, and an outlet 76 at the lowermost end of nozzle tip 70. The stepped throughbore 72 has a diameter within the nozzle tip 70 in the range of about 0.010 to 0.040 inches, and preferably in the range of about 0.0175 to 0.0185 inches.

The nozzle plate 46 is formed with a notch or seat 78 which extends from the inner surface 60 toward the outer surface 62 and is substantially concentric to the inlet 74 of stepped throughbore 72. This seat 78 mounts an O-ring 80 such that the outer or bottom surface and external peripheral edge of the O-ring 80 each contact a wall of the seat 78. The inner or top surface of the O-ring 80, and its internal peripheral surface 82, are not confined by any structure of the nozzle plate 46.

An annular groove 84 is formed in the nozzle attachment 46 which extends from its inner surface 60 toward the outer surface 62 and is radially outwardly spaced from the inlet 74 of stepped throughbore 72. The annular groove 84 defines a pair of side walls 86 and 88 which are substantially perpendicular to one another and intersect. Preferably, the side wall 88 is formed at approximately a 30° angle relative to the inner surface 60 of nozzle plate 46, and relative to the longitudinal axis of the stepped throughbore 72 in nozzle plate 46. As best shown in FIG. 3, six air jet bores 90 are formed in a nozzle plate between the annular groove 84 at its inner surface 60 and the outer surface 62. These air jet bores 90 are oriented at an angle of approximately 30° with respect to the longitudinal axis of stepped throughbore 72. The diameter of the air jet bores 90 is in the range of about 0.010 to 0.040 inches, and preferably in the range of about 0.017 to 0.019 inches.

The annular groove 84 facilitates accurate drilling of the air jet bores 90 so that they are formed at the desired angle relative to the stepped throughbore 72, and so that their outlets 91 are precisely located at the outer surface 62 of nozzle plate 46. By forming the side wall 88 at a 30° angle relative to the inner surface 60 of nozzle plate 46, a drill bit (not shown) can enter the annular groove 84 in the nozzle plate 46 at a 30° angle relative to its inner surface 60, but contact the side wall 88 formed by the annular groove 84 at substantially a 90° angle. As a result, the drilling operation is performed with minimal slippage between the drill bit and nozzle plate 46.

As shown in FIG. 3, the longitudinal axis of each of the air jet bores 90 is angled approximately 10° with respect to a vertical plane passing through the longitudinal axis of the stepped throughbore 72 and the center of each such bore 90 at the annular groove 84. For example, the longitudinal axis 92 of air jet bore 90A is angled approximately 10° relative to a vertical plane passing through the longitudinal axis of the stepped throughbore 72 and the center point 94 of bore 90A at the annular groove 84 in nozzle plate 46. As a result, the jet of pressurized air 96 from air jet bore 90A is directed substantially tangent to the outer periphery of the stepped throughbore 72 and the adhesive bead 98 (FIG. 2) ejected therefrom, as described more fully below.

In the embodiment of the invention illustrated in FIGS. 2 and 3, the nozzle cap 42 is formed as an essentially unitary structure by permanently interconnecting the nut 44 and nozzle plate 46. Preferably, the nozzle plate 46 is positioned against the outer end 54 of nut 44 and then the annular flange 58 of nut 44 is roll-formed against the peripheral edge 64 of nozzle plate 46. In the roll-forming process, the annular flange 58 of nut 44 is made to conform to the shape of the peripheral edge 64 of nozzle plate 46, including the configuration of its straight edge portion 66 and concavely arcuate portion 68. This roll-forming operation essentially permanently interconnects the nut 44 and nozzle plate 46, and forms an outer surface of nozzle cap 42 wherein the outer surface 62 of nozzle plate 46 is coplanar or flush with the annular flange 58 of nut 44. Only the nozzle tip 70 of nozzle plate 46 protrudes outwardly from such surface of the nozzle cap 42. This provides an advantage in the operation of dispensing device 10 as described below.

Figure 4:
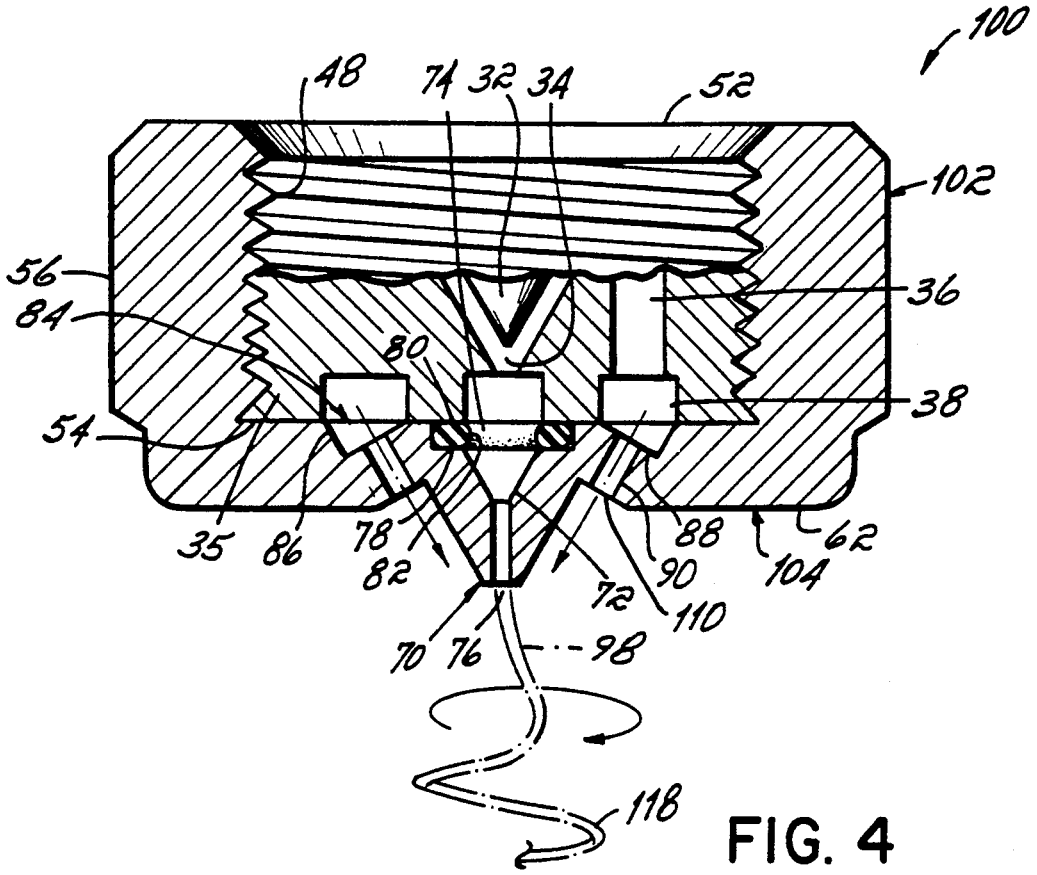
FIG. 4 is a cross sectional view of an alternative embodiment of the nozzle cap of this invention.

An alternative embodiment of a nozzle cap 100 is illustrated in FIG. 4. Nozzle cap 100 is similar in operation to nozzle cap 42, but has a completely integral construction instead of separately machined pieces as with nozzle cap 42. The nozzle cap 100 is preferably fabricated from a section of hex bar stock in which the nut portion 102 of the nozzle cap 100 is formed by drilling and tapping a bore within the hex stock. A nozzle plate portion 104 is formed in the hex stock where the bore in nut portion 102 terminates, which eliminates the connection between a separate nut 44 and nozzle plate 46 as described above in connection with the embodiment of FIGS. 1-3. The remaining structure of nozzle cap 100, including the adhesive and air delivery bores and O-ring 80, is identical to that of FIGS. 1-3 and is given the same reference numbers in FIG. 4. The only addition in the embodiment of FIG. 4 is a notch or groove 110 formed in the outer surface 62 of the nozzle plate portion 104. This additional groove 110 is helpful in drilling the air jet bores 90 through the nozzle plate portion 104. These bores 90 cannot be drilled from the groove 84 in the inner side 60 of nozzle plate portion 104 because of interference between the drill bit and the walls of the nut portion 102 of nozzle cap 100.

ASSEMBLY AND OPERATION OF NOZZLE CAP

One important aspect of this invention is that the nozzle cap 42 is constructed to help the operator avoid overtightening when mounting the nozzle cap 42 onto the nozzle 14 of gun body 12. For purposes of the present discussion, an assembly operation using nozzle cap 42 is explained, it being understood that the nozzle cap 100 is installed in the same manner.

Initially, the nut 44 of nozzle cap 42 is placed onto the threaded outer surface of nozzle 14 and rotated. The nut 44 moves freely along the nozzle 14 with minimal resistance which can be felt by the operator when either tightening the nozzle cap 42 by hand or with a tool such as a wrench. In the presently preferred embodiment, the top or inner surface of O-ring 80 protrudes from the inner surface 60 of nozzle cap 42 so that in the course of tightening the nozzle cap 42 onto the nozzle 14, the O-ring 80 is first to contact the lowermost end 35 of nozzle 14. When such contact is made, the operator can feel a frictional resistance to further tightening of the nozzle cap 42 as the O-ring 80 is compressed within seat 78. In other words, it is noticeably more difficult to turn the nozzle cap 42 after engagement with the O-ring 80 than before. As the operator continues tightening nozzle cap 42, the O-ring 80 eventually becomes compressed within the seat 78 to such an extent that the inner surface 60 of nozzle plate 46 contacts the lowermost end 40 of nozzle 14. This positive, metal-to-metal contact is readily sensed by the operator as being noticeably different from the resistance provided by the O-ring 80. Once such engagement between the inner surface 60 of nozzle plate 46 and lowermost end 40 of nozzle 14 is felt by the operator, he or she is put on notice to stop further tightening of the nozzle cap 42. This reduces the potential for overtightening the nozzle cap 42 to a degree wherein the nozzle plate 46 could bend or distort against the nozzle 14.

With the nozzle cap 42 mounted in place on the nozzle 14, heated hot melt adhesive is introduced into the stepped bore 30 of nozzle 14 through the adhesive manifold 16. The plunger 32 is retracted to allow the adhesive to flow through the discharge outlet 34 of stepped bore 30 and into the stepped throughbore 72 of nozzle plate 46. As viewed in FIG. 2, a bead 98 of adhesive is discharged from the outlet 76 of nozzle tip 70 toward a substrate (not shown).

In the presently preferred embodiment, the hydraulic pressure, or pressure at which the hot melt adhesive is pumped through the system, is on the order of about 1200 psi compared to a pressure of about 35 psi at which air is delivered to the air jet bores 90. It is believed that because the adhesive moves through the interior of O-ring 80 at the inlet 74 to the stepped throughbore 72 and nozzle plate 46, the hydraulic pressure of the adhesive forces the O-ring 80 radially outwardly into firm engagement with the walls of the seat 78 and the lowermost end 35 of nozzle 14. Any force applied in the opposite direction on the O-ring 80 by the pressurized air entering air jet bores 90 is overcome by the much greater hydraulic pressure of the adhesive, i.e., 1200 psi hydraulic pressure versus 35 psi air pressure. Such pressurization of the O-ring 80 ensures that a fluid-tight seal is maintained at the stepped throughbore 72 of nozzle plate 46 to prevent the leakage of adhesive along the inner surface 60 of nozzle plate 46 and into the air jet bores 90.

The air jet bores 90 are angled relative to the longitudinal axis of the throughbore 72 so that the jets of air 96 flowing therethrough impact the adhesive bead 98 substantially tangent to its outer periphery and at an angle of about 30° with respect to the longitudinal axis of stepped throughbore 72. The air ejected from the air jet bores 90 performs two functions. First, the jets of air 96 attenuate or stretch the adhesive bead 98 forming an elongated strand or fiber 118 of hot melt adhesive for deposition onto a substrate. Additionally, since the air jet bores 90 are oriented to direct the jets of air 96 tangent to the outer periphery of the adhesive bead 98, the adhesive fiber 118 formed therefrom is rotated in a compact spiral path toward the substrate. As a result, a controlled, substantially spiral pattern of an elongated adhesive strand 118 is obtained in the substrate.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A nozzle cap for use in an apparatus for dispensing hot melt adhesive which includes a gun body having a nozzle formed therein with an adhesive passageway for conveying heated hot melt adhesive, an air delivery passageway for conveying pressurized air, and an annular wall separating said adhesive passageway and said air delivery passageway, said nozzle cap comprising:

a threaded nut having a first end and a second end, said threaded nut being adapted to mount to the nozzle of the adhesive dispensing device;

a nozzle plate having a first surface, a second surface and a peripheral edge extending between said first and second surfaces, one of said first and second ends of said nut being forced into engagement with said peripheral edge of said nozzle plate to essentially permanently interconnect said nut and said nozzle plate;

a nozzle tip extending outwardly from said second surface of said nozzle plate, said nozzle plate being formed with a central throughbore having an inlet at said first surface in communication with the adhesive passageway in the nozzle and an outlet at said nozzle tip;

said nozzle plate being formed with an annular recess surrounding said inlet to said throughbore;

an O-ring disposed in said recess substantially concentric to said inlet, said O-ring having a central opening communicating with said adhesive passageway in said nozzle and said outlet at said nozzle tip whereby heated hot melt adhesive flows from the adhesive passageway in the nozzle, through said O-ring and into contact with said O-ring, into said inlet of said throughbore and is discharged from said outlet at said nozzle tip to form an adhesive bead;

said nozzle plate being formed with a plurality of bores surrounding said central throughbore and extending between said first and said second surfaces, said bores being in communication with the air delivery passageway in the nozzle, said bores each being formed at an angle with respect to said central throughbore in said nozzle plate to direct pressurized air flowing therethrough into contact with said adhesive bead to form an elongated adhesive fiber for deposition on a substrate;

said O-ring being positioned to engage said annular wall to provide a seal between said adhesive passageway and said air delivery passageway.

2. The nozzle cap of claim 1 in which one of said first and second ends of said nut is formed with an annular flange, said annular flange being roll-formed onto said peripheral edge of said nozzle plate to essentially permanently interconnect said nut and said nozzle plate.

3. The nozzle cap of claim 2 in which said annular flange is roll-formed substantially flush with said second surface of said nozzle plate.

4. The nozzle cap of claim 2 in which said peripheral edge of said nozzle plate includes an annular, substantially straight portion extending from said first surface toward said second surface, and an annular, concavely arcuate portion extending between said straight portion and said second surface.

5. The nozzle cap of claim 1 in which said O-ring is dimensioned so as to extend inwardly beyond said first surface and to be partially compressed in said recess when said nozzle cap is mounted upon said gun body to form an initial seal between said annular wall and said plate portion, said O-ring being forced radially outwardly by the pressure of said hot melt adhesive to augment the seal between said annular wall and said plate portion.

6. The nozzle cap of claim 1 in which said O-ring is dimensioned to extend inwardly beyond said first surface and to be partially compressed as said nut is threaded onto said gun body to increase the frictional resistance to turning of said nozzle cap prior to contact of said annular wall with said first surface of said nozzle plate.

7. The nozzle cap of claim 1 in which said throughbore is of stepped configuration including a first portion of small diameter adjacent to the tip of said nozzle, a second portion of increasing diameter communication with said first portion and said recess, said recess being of a diameter greater than said second portion.

8. A nozzle cap for use in an apparatus for dispensing hot melt adhesive which includes a gun body having a nozzle formed therein with an adhesive passageway for conveying heated hot melt adhesive, an air delivery passageway for conveying pressurized air, and an annular wall separating said adhesive passageway and said air delivery passageway, said nozzle comprising:

a one-piece nozzle mounting portion and nozzle plate portion, said nozzle mounting portion comprising a threaded nut adapted to mount to the nozzle of the gun body;

said nozzle plate portion being formed with a first surface on the inner side of said nozzle plate portion, a second surface on the outer side of said nozzle plate portion and a nozzle tip extending outwardly from said second surface;

said nozzle plate portion being formed with a central throughbore having an inlet at said first surface in communication with the adhesive passageway in the nozzle and an outlet at said nozzle tip;

said nozzle plate portion being formed with an annular recess surrounding said inlet to said throughbore;

an O-ring disposed in said recess substantially concentric with said inlet, said O-ring having a central opening communicating with said adhesive passageway in said nozzle and the outlet at said nozzle tip whereby heated hot melt adhesive flows from the adhesive passageway in the nozzle, through said O-ring and in contact with said O-ring, into said inlet of said central throughbore and is discharged from the outlet at said nozzle tip to form an adhesive bead;

said nozzle plate being formed with a plurality of bores surrounding said central throughbore and extending between said first and said second surfaces, said bores being in communication with said air delivery passageway in said nozzle, said bores being formed at an angle with respect to said central throughbore in said nozzle plate to direct pressurized air flowing therethrough into contact with the adhesive bead to form an elongated adhesive fiber for deposition on a substrate;

said O-ring being positioned to engage said annular wall to provide a seal between said adhesive passageway and said air delivery passageway.

9. The nozzle cap of claim 8 in which said nozzle mounting portion has a threaded internal bore extending from a first end of said nozzle mounting portion toward a second end thereof, said nozzle plate being located at said second end of said nozzle mounting portion where said internal bore terminates.

10. The nozzle cap of claim 8 in which said O-ring is dimensioned so as to extend inwardly beyond said first surface and to be partially compressed in said recess when said nozzle cap is mounted upon said gun body to form an initial seal between said annular wall and said plate portion, said O-ring being forced radially outwardly by the pressure of said hot melt adhesive to augment the seal between said annular wall and said plate portion.

11. The nozzle cap of claim 8 in which said O-ring is dimensioned to extend inwardly beyond said first surface and to be partially compressed as said nut is threaded onto said gun body to increase the frictional resistance to turning of said nozzle cap prior to contact of said annular wall with said first surface of said plate portion.

12. The nozzle cap of claim 8 in which said central throughbore is of stepped configuration including a first portion of small diameter adjacent to the tip of said nozzle, a second portion of increasing diameter communicating with said first portion and said recess, said recess being of a diameter greater than said second portion.

* * * * *

UNITED STATES PATENT AND TRADEMARK OFFICE

CERTIFICATE OF CORRECTION

PATENT NO. : 5,065,943

DATED : November 19, 1991

INVENTOR(S) : Bentley J. Boger et al

It is certified that error appears in the above-identified patent and that said Letters Patent is hereby corrected as shown below:

In column 6, line 31, please delete "!8" and insert --18--.

In column 11, line 12, please delete "claim 2" and insert --claim 1--.

Signed and Sealed this

Twenty-third Day of March, 1993

*Attest:*

STEPHEN G. KUNIN

*Attesting Officer*

*Acting Commissioner of Patents and Trademarks*